US007441280B2

(12) United States Patent
Lewis et al.

(10) Patent No.: US 7,441,280 B2
(45) **Date of Patent: *Oct. 28, 2008**

(54) LINER PROVIDING BARRIER FOR PROTECTIVE GARMENT AND PROTECTIVE GARMENT COMPRISING SAME

(75) Inventors: Patricia K. Lewis, Tipp City, OH (US); William L. Grilliot, Dayton, OH (US); Mary I. Grilliot, Dayton, OH (US)

(73) Assignee: Morning Pride Manufacturing, L.L.C., Dayton, OH (US)

( * ) Notice: Subject to any disclaimer, the term of this patent is extended or adjusted under 35 U.S.C. 154(b) by 160 days.

This patent is subject to a terminal disclaimer.

(21) Appl. No.: 11/488,232

(22) Filed: Jul. 18, 2006

(65) Prior Publication Data

US 2008/0229483 A1 Sep. 25, 2008

Related U.S. Application Data

(63) Continuation of application No. 10/962,922, filed on Oct. 12, 2004, now Pat. No. 7,137,147.

(51) Int. Cl.
*A41D 1/00* (2006.01)

(52) U.S. Cl. ..... 2/97

(58) Field of Classification Search ..... 2/97, 2/456, 457, 458, 49.4, 49.5, 108, 69, 102, 2/70, 81, 93, 904, 915, 272, 164, 126, DIG. 2
See application file for complete search history.

(56) References Cited

U.S. PATENT DOCUMENTS 3,102,270 A 9/1963 Izzo
3,110,901 A 11/1963 Lesnow
4,748,691 A 6/1988 Grilliot et al.
5,532,037 A 7/1996 Aumann
5,638,547 A 6/1997 Hewitt
5,662,638 A 9/1997 Johnson et al.
6,243,872 B1 6/2001 Snedeker
6,691,317 B2 * 2/2004 Cochran ..... 2/97
6,691,326 B2 2/2004 Hexels
7,137,147 B2 * 11/2006 Lewis et al. ..... 2/97

* cited by examiner

*Primary Examiner*—Tejash Patel
(74) *Attorney, Agent, or Firm*—Wood, Phillips, Katz, Clark & Mortimer

(57) ABSTRACT

For and in a protective garment having an outer shell, a liner having a barrier side and an opposite side and having, on the barrier side, a moisture barrier or a barrier against chemical or biological agents is folded along two folds, which are parallel when laid flat and straightened, so as to form a fin projecting from the opposite side. A seal providing a similar barrier is provided between the folds. A plural-part fastener, such as a snap fastener or a hook-and-loop fastener, is used to fasten the liner having the barrier to and within the outer shell. One part of the plural-part fastener is mounted to the liner and another part of the plural-part fastener is mounted to the outer shell. Moreover, the liner may have a barrier on each side and be similarly formed with a similar fin projecting oppositely, having a similar seal, and mounting one part of a similar fastener, whereby a thermal liner mounting another part of the similar fastener may be similarly fastened to and within the liner having the barriers.

11 Claims, 1 Drawing Sheet

LINER PROVIDING BARRIER FOR PROTECTIVE GARMENT AND PROTECTIVE GARMENT COMPRISING SAME

CROSS-REFERENCE TO RELATED APPLICATION

This application is a continuation of U.S. patent application Ser. No. 10/962,922, which was filed on Oct. 12, 2004.

TECHNICAL FIELD OF THE INVENTION

This invention pertains to a liner providing a moisture barrier or a barrier of another type for a protective garment, such as a firefighter's coat or an emergency rescue worker's coat, and to a protective garment comprising such a liner. The liner providing the barrier has a novel fin, which is useful in fastening the liner providing the barrier to and within an outer shell of such a garment or in fastening a thermal liner to and within the liner providing the barrier.

BACKGROUND OF THE INVENTION

Conventionally, a protective coat for a firefighter or for an emergency rescue worker has an outer shell, within which a liner providing a moisture barrier is worn. Commonly, a thermal liner is worn within the liner providing the moisture barrier. The firefighter or the emergency rescue worker may have to rely on the moisture barrier to protect himself or herself against wide varieties of possible chemical or biological hazards.

Conventionally, fasteners, such as zippers, snap fasteners, or hook-and-loop fasteners are sewn to the liner or are riveted to the liner and are used to fasten the liner to and within the outer shell. Similar fasteners may be also used to fasten a thermal liner to and within the outer shell. Disadvantageously, however, the moisture barrier is compromised wherever such fasteners are sewn to the liner providing the moisture barrier or are riveted to the liner providing the moisture barrier.

Sealing tapes, which are used to seal seams in protective garments, are described in the "Background of the Invention" in U.S. Pat. No. 6,789,592 B2, the disclosure of which is incorporated herein by reference.

SUMMARY OF THE INVENTION

This invention provides for a protective garment, such as a firefighter's coat or an emergency rescue worker's coat, a liner having a barrier side and an opposite side and having, on the barrier side, a moisture barrier or a barrier against chemicals or against biological agents.

This invention contemplates that the liner is folded along two folds, which are parallel when laid flat and straightened, so as to form a fin projecting from the opposite side. This invention further contemplates that a seal providing a barrier similar to the barrier provided on the barrier side of the liner is provided between the folds.

In one contemplated mode for providing the seal between the folds, a seal providing a similar barrier is applied to the barrier side so as to bridge the folds. In an alternative mode for providing the seal between the folds, the folds are caused to adhere to each other by welding, if the barrier is weldable, adhesively, or otherwise, so as to provide a similar barrier where the folds adhere to each other.

Preferably, the folds are contiguous. Preferably, the fin is formed as a loop, which is continuous between the folds.

Preferably, a fastening means is mounted to the fin, more preferably one part of a plural-part fastener, such as a snap fastener or a hook-and-loop fastener.

This invention also provides a protective garment, such as a firefighter's coat or an emergency rescue worker's coat, which comprises an outer shell and the liner described above. The liner described above is worn within the outer shell. The fastening means fastens the liner described above to and within the outer shell. If a plural-part fastener is used, such as a snap fastener or a hook-and-loop fastener, one part of the plural-part fastener is mounted to the liner described above and the other part of the plural-part fastener is mounted to the outer shell.

This invention also provides a protective garment, such as a firefighter's coat or an emergency rescue worker's coat, which comprises a thermal liner and the liner described above. The thermal liner is worn within the liner described above. The fastening means fastens the thermal liner to and within the liner described above. If a plural-part fastener is used, such as a snap fastener or a hook-and-loop fastener, one part of the plural-part fastener is mounted to the liner described above and the other part of the plural-part fastener is mounted to the thermal liner.

DETAILED DESCRIPTION OF THE ILLUSTRATED EMBODIMENTS

Figure 1:
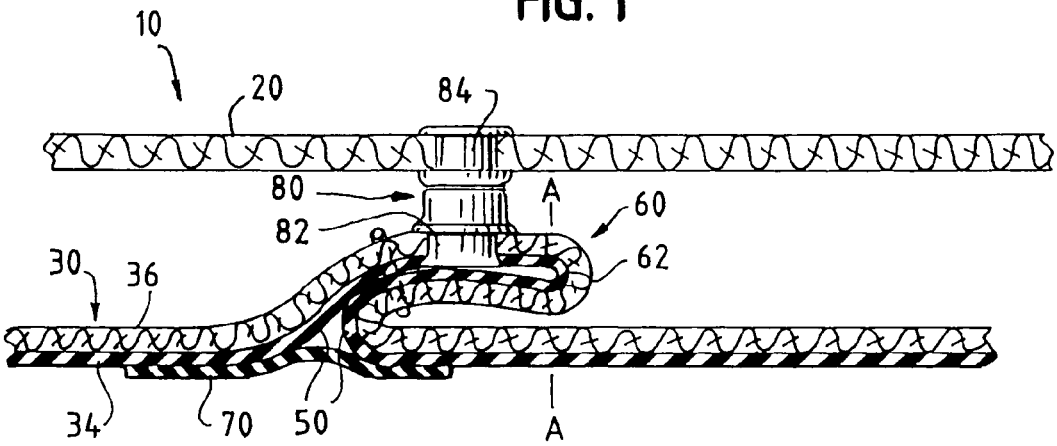
FIG. 1 is a fragmentary, cross-sectional view of a protective garment constituting a preferred embodiment of this invention.

In the preferred embodiment illustrated in FIG. 1, a protective garment 10, such as a firefighter's coat or an emergency rescue worker's coat, comprises an outer shell 20 and a liner 30, which is worn within the outer shell 20. The liner 30 has two layers bonded to each other, namely, a layer 34 providing a barrier on a barrier side of the liner 30 and a fabric layer 36 on an opposite side of the liner 30. As provided on the barrier side of the liner, the barrier is a moisture barrier or a barrier against chemicals or biological agents.

As illustrated in FIG. 1, the layer 34 provides a moisture barrier on the barrier side of the liner 30 and is a membrane of a synthetic rubber, such as neoprene. Alternatively, the barrier provided on the barrier side of the liner 30 is a moisture barrier provided by a suitable material, such as polytetrafluoroethylene, which is sprayed onto the barrier side of the liner 30 or into which the liner 30 is dipped. Alternatively, the barrier provided on the barrier side of the liner 30 is provided by a similar or dissimilar material, however applied, which provides a moisture barrier or a barrier against chemical or biological agents.

So as to permit mounting of the liner 30 to and within the outer shell 20, the liner 30 is folded along two folds 50, which are parallel when laid flat and straightened, which are contiguous, and which are sewn to each other by stitches 52, so as to form a fin 60 projecting from the fabric layer 36. As described in the following paragraph, a seal providing a barrier similar to the barrier provided on the barrier side of the liner 30 is provided between the folds 50.

As illustrated in FIG. 1, a sealing tape 70 providing a moisture barrier is applied to the layer 34 so as to bridge the folds 50. Alternatively, if the barrier material is weldable, the folds 50 are welded to each other so as to provide a barrier similar to the barrier provided on the barrier side of the liner 30. Alternatively, the folds 50 are caused to adhere to each other in a different way, possibly via a suitable adhesive, so as to provide a barrier similar to the barrier provided on the barrier side of the liner 30.

Preferably, as illustrated in FIG. 1, the fin 60 is folded as a loop, which is continuous between the folds 50, so as to have a folded, distal edge 62, which is parallel to the folds 50. Alternatively, as if the portions to the right of line A-A in FIG. 1 were removed, the fin 60 could have two distal edges, which would not be joined.

As illustrated in FIG. 1, a snap fastener 80 is provided, which has a first part 82 mounted to the fin 60, which has a second part 84 mounted to the outer shell 20, and which is used to mount the liner 30 demountably to and within the outer shell 20. The snap fastener 80 is an example of a series of similar fasteners used to mount the liner 30 demountably to and within the outer shell 20.

Figure 2:
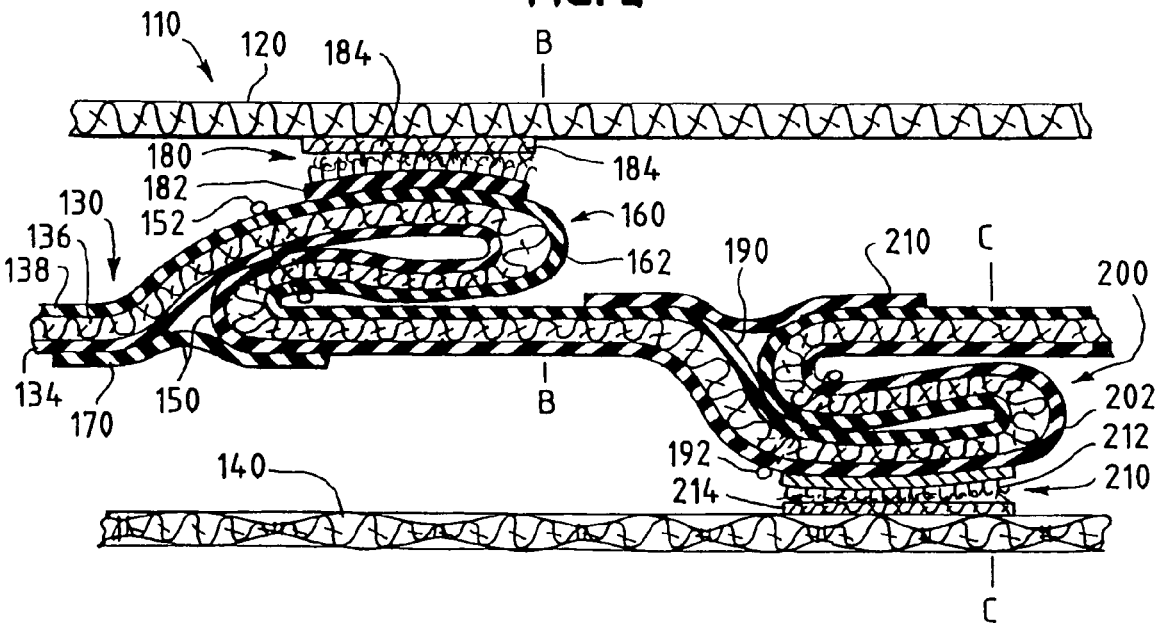
FIG. 2 is a fragmentary, cross-sectional view of a protective garment constituting an alternative embodiment of this invention.

In the alternative embodiment illustrated in FIG. 2, a protective garment 110, such as a firefighter's coat or an emergency rescue worker's coat, comprises an outer shell 120, a liner 130, which is worn within the outer shell 120, and a thermal liner 140, which is worn within the liner 130. The liner 130 has three layers bonded to one another, namely, a layer 134 providing a moisture barrier on a given side of the liner 130, an intermediate, fabric layer 136, and a layer 138 providing a moisture barrier on an opposite side of the liner 130. Each of the given and opposite sides of the liner 130 may be thus regarded as a barrier side of the liner 130.

As illustrated in FIG. 2, each of the layers 134, 138, provides a moisture barrier on its respective side of the liner 30 and is a membrane of a synthetic rubber, such as neoprene. Alternatively, the barrier provided on each of the respective sides of the liner 30 is a moisture barrier provided by a suitable material, such as polytetrafluoroethylene, which is sprayed onto the barrier side of the liner 30 or into which the liner 30 is dipped. Alternatively, the barrier provided on each of the respective sides of the liner 30 is provided by a similar or dissimilar material, however applied, which provides a moisture barrier or a barrier against chemical or biological agents.

So as to permit mounting of the liner 130 to and within the outer shell 120, the liner 130 is folded along two folds 150, which are parallel when laid flat and straightened, which are contiguous, and which are sewn to each other by stitches 152, so as to form a fin 160 projecting from the fabric layer 136. As described in the following paragraph, a seal providing a barrier similar to the barrier provided on the barrier side of the liner 130 is provided between the folds 150.

As illustrated in FIG. 2, a sealing tape 170 providing a barrier similar to the barrier provided on the adjacent side of the liner 30 is applied to the layer 134 so as to bridge the folds 140. Alternatively, if the barrier material is weldable, the folds 150 are welded to each other so as to provide a barrier similar to the barrier provided on the adjacent side of the liner 30. Alternatively, the folds 150 are caused to adhere to each other in a different way, possibly via a suitable adhesive, so as to provide a barrier similar to the barrier provided on the adjacent side of the liner 30.

Preferably, as illustrated in FIG. 2, the fin 160 is folded as a loop, which is continuous between the folds 150, so as to have a folded, distal edge 162, which is parallel to the folds 140. Alternatively, as if the portions to the right of line B-B in FIG. 2 were removed, the fin 160 could have two distal edges, which would not be joined.

As illustrated in FIG. 2, a hook-and-loop fastener 180 is provided, which has a first part 182 mounted to the fin 150, which has a second part 184 mounted to the outer shell 120, and which is used to mount the liner 130 demountably to and within the outer shell 120.

So as to permit mounting of the thermal liner 140 to and within the liner 130, the liner 130 is folded along two folds 190, which are parallel when laid flat and straightened, which are contiguous, and which are sewn to each other by stitches 192, so as to form a fin 200 projecting from the layer 134. As described in the following paragraph, a seal providing a barrier similar to the barrier provided on the barrier side of the liner 130 is provided between the folds 190.

As illustrated in FIG. 2, a sealing tape 210 providing a barrier similar to the barrier provided on the adjacent side of the liner 130 is applied to the layer 138 so as to bridge the folds 140. Alternatively, if the barrier material is weldable, the folds 190 are welded to each other so as to provide a barrier similar to the barrier provided on the adjacent side of the liner 30. Alternatively, the folds 190 are caused to adhere to each other in a different way, possibly via a suitable adhesive, so as to provide a barrier similar to the barrier provided on the adjacent side of the liner 130.

Preferably, as illustrated in FIG. 2, the fin 200 is folded as a loop, which is continuous between the folds 190, so as to have a folded, distal edge 202, which is parallel to the folds 140. Alternatively, as if the portions to the right of line C-C in FIG. 2 were removed, the fin 200 could have two distal edges, which would not be joined.

As illustrated in FIG. 2, a hook-and-loop fastener 210 is provided, which has a first part 212 mounted to the fin 190, which has a second part 214 mounted to the thermal liner 140, and which is used to mount the thermal liner 140 demountably to and within the liner 130.

In the illustrated embodiments, zippers, snap fasteners, and hook-and-loop fasteners may be interchangeably used as fastening means. Common characteristics of zippers, snap fasteners, and hook-and-loop fasteners are that zippers, snap fasteners, and hook-and-loop fasteners are two-part, releasable fasteners. Whatever fastening means are used, the barriers are sealed wherever the barriers are compromised by fastener parts being mounted to the liners providing the moisture barriers, whether the barriers are moisture barriers or barriers against chemicals or against biological agents.

The invention claimed is:

1. For a protective garment, a liner having a barrier side, a weldable barrier on the barrier side, and an opposite side, the liner being folded along two folds, which are parallel when laid flat and straightened, so as to form a fin projecting from the opposite side, wherein a fastening means is mounted to the fin so as to compromise the barrier, wherein a seal providing a similar barrier is provided on the barrier side, at which the folds are welded to each other so as to provide the seal.

2. The liner of claim 1, wherein the fastening means is one part of a plural-part, releasable fastener.

3. The liner of claim 2, wherein the plural-part fastener is a snap fastener.

4. The liner of claim 2, wherein the plural-part fastener is a hook-and-loop fastener.

5. A protective garment comprising:

an outer shell; and a liner located within the outer shell, the liner having a barrier side, a weldable barrier on the barrier side, and an opposite side, the liner being folded along two folds, which are parallel when laid flat and straightened, so as to form a fin projecting from the opposite side, wherein a fastening means is mounted to the fin so as to compromise the barrier, wherein a seal providing a similar barrier is provided on the barrier side, at which the folds are welded to each other so as to provide the seal.

6. The protective garment of claim 5, wherein the fastening means is one part of a plural-part, releasable fastener.

7. The protective garment of claim 6, wherein the protective garment further comprises a thermal lining worn within the liner, the plural-part fastener having another part mounted to the thermal lining.

8. The protective garment of claim 6, wherein the plural-part fastener is a snap fastener.

9. The protective garment of claim 8, wherein the protective garment further comprises a thermal lining worn within the liner, the plural-part fastener having another part mounted to the thermal lining.

10. The protective garment of claim 6, wherein the plural-part fastener is a hook-and-loop fastener.

11. The protective garment of claim 10, wherein the protective garment further comprises a thermal lining worn within the liner, the plural-part fastener having another part mounted to the thermal lining.

* * * * *